United States Patent [19]

Anderson

[11] 4,166,215

[45] Aug. 28, 1979

[54] METHODS AND APPARATUS FOR DETERMINING DYNAMIC FLOW CHARACTERISTICS OF PRODUCTION FLUIDS IN A WELL BORE

[75] Inventor: Ronald A. Anderson, Houston, Tex.

[73] Assignee: Schlumberger Technology Corporation

[21] Appl. No.: 835,933

[22] Filed: Sep. 23, 1977

[51] Int. Cl.[2] ..... G01V 5/00

[52] U.S. Cl. ..... 250/260; 250/356

[58] Field of Search ..... 250/260, 264, 265, 266, 250/303, 356

[56] References Cited

U.S. PATENT DOCUMENTS

| | | | |
|---|---|---|---|
| Re. 27,272 | 1/1972 | Young | 250/260 |
| 2,617,941 | 11/1952 | Craggs | 250/260 |
| 4,035,640 | 7/1977 | Arnold et al. | 250/265 |

*Primary Examiner*—Davis L. Willis

[57] ABSTRACT

In the representative embodiments of the new and improved methods and apparatus disclosed herein, a well tool incorporating the principles of the present invention is arranged for selectively discharging discrete minor quantities of a first radioactive tracer and of a second radioactive tracer. When the tool is stationed in a production well, upon discharge of whichever one of the two tracers that is believed to be miscible in the continuous-phase fluid at that depth location, radiation detectors arranged at spaced locations on the tool respond to provide one or more measurements of the level of radioactivity in the well bore fluids from which one or more dynamic flow characteristics of the continuous-phase fluid at that depth location may be determined.

43 Claims, 8 Drawing Figures

METHODS AND APPARATUS FOR DETERMINING DYNAMIC FLOW CHARACTERISTICS OF PRODUCTION FLUIDS IN A WELL BORE

Although there are various techniques employing impeller-type flowmeters or tracer-survey tools for determining flow rates or velocities of injection fluids at different depths in fluid-injection wells, such measurement techniques have been generally recognized heretofore as being not well suited for accurately monitoring production wells. Accordingly, the previous practice has been to simply determine those conditions that can be reliably measured in a production well and either make various simplifying or empirical assumptions regarding any variables that cannot be readily determined or else obtain relevant indirect measurements from which such variables can be computed.

Those who are skilled in the art recognize that perhaps the most-significant factor affecting the accuracy of quantitative or dynamic flow measurements in production wells is that, for the large part, the fluids in such wells are ordinarily multiphase fluids (i.e., mixtures of water and/or gas and/or oil) in varying, and usually unknown, proportions. As a result, since the conditions in a production well are so variable, measurements obtained at one depth location cannot be reliably used for accurately determining dynamic conditions at other depth locations in the well. Similarly, surface measurements can rarely be used to predict downhole flow conditions. For instance, it is not uncommon for a well to be producing both hydrocarbons and water even though the oil recovered at the surface appears to be free of water. On the other hand, the production of oil, gas and water at the surface is not necessarily indicative of triphasic conditions at all depths in a well since the pressures at extreme depths are often sufficient to keep most or all of the gas in solution.

Where, for example, the fluids in a given production well are a mixture of water and oil, the velocity of the oil phase of the mixture at any given depth location will always be substantially greater than that of the associated water phase regardless of which fluid predominates at that depth location; and in a typical multiple-zone production well, the ratio of these velocities will ordinarily vary from one depth location to another. Moreover, under normal well bore conditions, it is not at all uncommon for an oil/water mixture of well bore fluids at lower depths to be in the form of oil bubbles rising rapidly through a slowly-moving stream of water; and, as more oil enters the well bore from higher production zones, for this situation to be reversed at higher locations. Similar changes will, of course, occur whenever gas is also being produced along with either oil or gas inasmuch as the size and number of entrained gas bubbles will increase as the mixture of production fluids move upwardly. As a result, the dynamic flow conditions at different depth locations in a production well are unpredictable and the fluids at any given depth can be in different states or phases respectively traveling at different velocities.

It will be understood, therefore, that the determination of the dynamic characteristics of multiphase well bore fluids at different depth locations in a typical production well is not easy. For instance, with impeller-type flowmeters, it is not always possible to accurately calibrate the tool for measuring the flow rate of liquids where biphasic or triphasic conditions exist. Similarly, although the measurement of water velocities in water-injection wells is usually possible with conventional tracer-survey tools, when such tools are operated in multiphase fluids it has not been possible heretofore to accurately measure the velocity of a continuous phase of water where gas or oil bubbles are passing through the water column. A similar problem exists where oil is the continuous-phase fluid and gas is the discontinuous-phase fluid. Moreover, with such conventional tools, it is difficult to obtain reliable measurements where oil is bubbling upwardly through a static column of water at a given depth location in a production well or there is a downward movement of continuous-phase water occurring simultaneously with an upward movement of oil bubbles.

Accordingly, it is an object of the present invention to provide new and improved tracer-survey methods and apparatus for obtaining measurements representative of the dynamic flow characteristics of the continuous-phase fluid present at one or more depth locations in a production well containing a lighter discontinuous-phase well bore fluid.

This and other objects of the present invention are attained by periodically discharging minor amounts of a suitable radioactive tracer into the fluids at a selected depth location in a production well. Thereafter, by simultaneously monitoring the level of radioactivity present in the well bore fluids above and below that depth location, measurements will be obtained which are representative of one or more dynamic flow characteristics of the heavier continuous-phase fluid at that depth location in the well bore.

To practice the methods of the present invention, further objects of the invention are attained by arranging tracer-ejecting means for selectively discharging first one and then the other of two selected radioactive tracers into the well bore fluids around the tool. Tracer-detecting means are further arranged above and below such tracer-discharge points for simultaneously obtaining one or more measurements which are respectively representative of the level of radioactivity in the well bore fluids which are then adjacent to those measuring points.

The novel features of the present invention are set forth with particularity in the appended claims. The invention together with further objects and advantages thereof, may be best understood by way of the following description of exemplary methods and apparatus respectively employing the principles of the invention as illustrated in the accompanying drawings, in which:

Figures 1, 2:
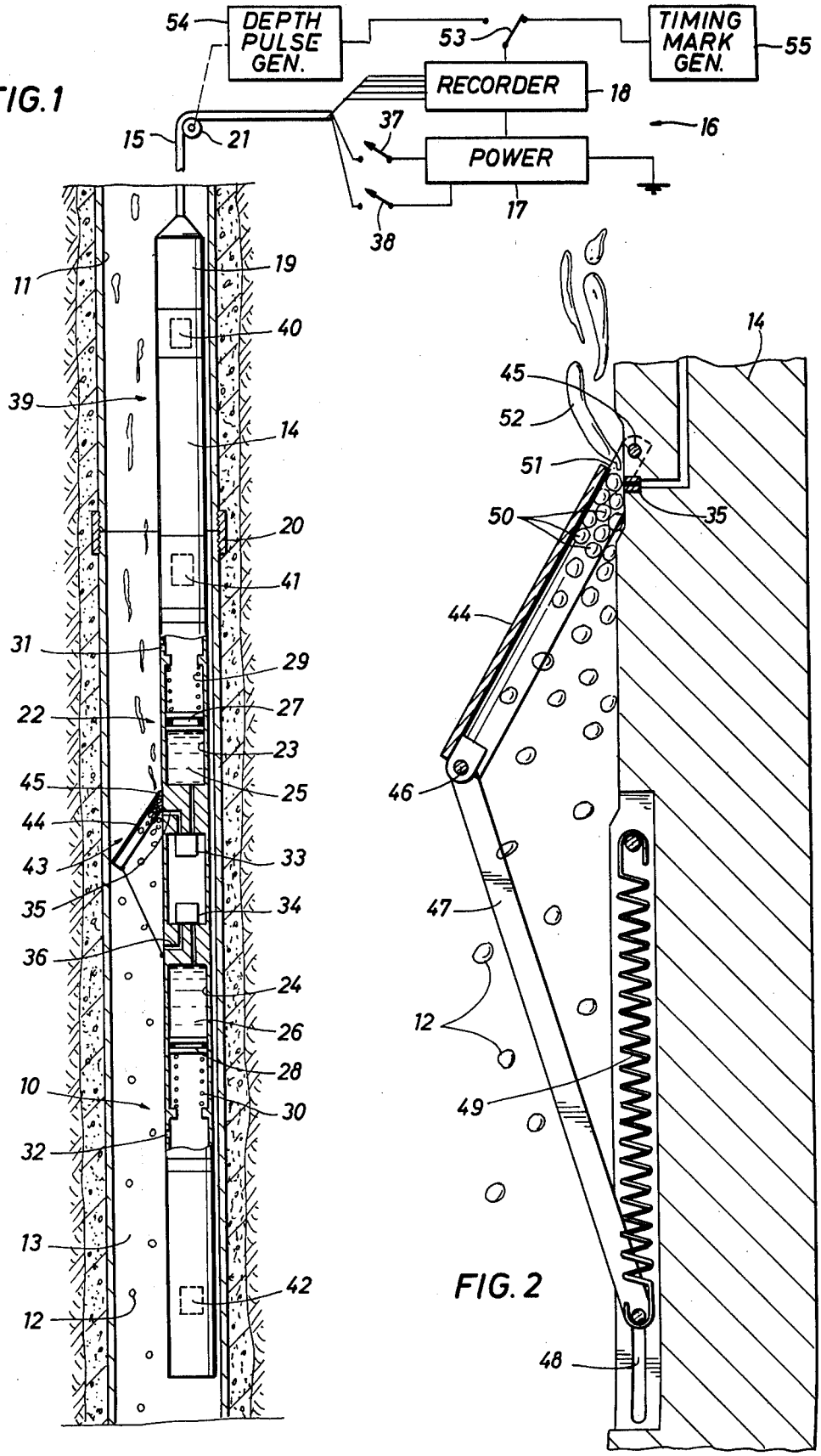
FIG. 1 is a somewhat-schematic presentation of a preferred embodiment of a new and improved tracer-survey tool as it may appear while performing the methods of the present invention for determining the dynamic flow characteristics of a continuous-phase fluid in a typical production well containing a lighter discontinuous-phase fluid.
FIG. 2 is an enlarged view of the ejector section which may be included with the survey tool shown in FIG. 1, with this figure depicting the ejection of a fluent tracer material into a stream of oil bubbles within a continuous-phase of water around the tool when the dynamic flow characteristics of the oil are also to be determined.

Turning now to FIG. 1, a new and improved tracer-survey tool 10 arranged in accordance with the principles of the present invention is shown while practicing the methods of this invention for determining dynamic flow conditions of a heavier continuous-phase well bore fluid within a typical production well as at 11 containing a lighter discontinuous-phase fluid. As is common, the well bore fluids at the particular depth location in the well 11 depicted in FIG. 1 are comprised of a stream of dispersed bubbles, such as the oil bubbles shown at 12, which are rapidly rising through a slower-moving stream or continuous-phase fluid such as the water shown at 13. The velocity of the bubbles, as at 12, of the lighter discontinuous-phase fluid will as previously mentioned always be significantly greater than the velocity of the adjacent column of the heavier continuous-phase fluid as at 13.

The preferred embodiment of the new and improved tracer-survey tool 10 shown in FIG. 1 includes an elongated body 14 dependently suspended from a typical logging cable 15 which is spooled on a powered winch (not shown) at a convenient surface location adjacent to the well 11. As is usual, the cable 15 has one or more electrical conductors that are cooperatively coupled to surface instrumentation 16 which preferably includes a selectively-controlled source of electrical power 17 and recording means such as a typical galvanometer-type or CRT recorder 18 arranged for individually recording various electrical output signals on suitable recording media such as a movable roll of film which is progressively advanced as a function of either time or depth. A typical collar locator 19 is also preferably mounted on the upper end of the tool body 14 and coupled to the cable 15 for providing distinctive electrical output signals as the tool 10 is moved past couplings or casing collars, as at 20, in the cased well bore 11. The surface instrumentation 16 further includes a depth-measuring wheel 21 arranged in a typical fashion to utilize the travel of the cable 15 for progressively driving film through the recorder 18 in proportion to the movements of the survey tool 10 to a selected measuring station in the well bore 11 so as to provide a log record of the respective depth locations of the collars 20.

To identify fluids in the well bore 11, the survey tool 10 is also provided with tracer-ejecting means 22 selectively controllable by way of the surface instrumentation 16 and adapted for repetitively discharging controlled amounts of fluent tracer materials into the well bore. In the preferred embodiment of the survey tool 10 shown in FIG. 1, the tracer-ejecting means 22 include upper and lower enclosed chambers 23 and 24 spatially disposed within the tool body 14 for respectively containing pressured fluent tracers such as typical radioactive liquid tracers 25 and 26. To maintain the liquid tracers 25 and 26 at pressures which are at least slightly greater than the hydrostatic pressure of the connate fluids in the well 11, piston members 27 and 28 are respectively arranged in the fluid chambers 23 and 24 and normally biased as by compression springs 29 and 30 for maintaining the tracer contained in each chamber at predetermined elevated pressures. Ports 31 and 32 are arranged in the body 14 for communicating the hydrostatic pressure of the well fluids with the pistons 27 and 28. With the illustrated arrangement of the new and improved survey tool 10, the tracers 25 and 26 will, of course, be maintained at elevated pressures which exceed the well bore pressure at the present depth location of the tool by a pressure differential that is proportional to the predetermined forces respectively provided by the springs 29 and 30.

To control the release of the tracers 25 and 26 from their respective chambers 23 and 24, in the preferred embodiment of the survey tool 10 the tracer-ejecting means 22 further include normally-closed solenoid valves 33 and 34 that are fluidly coupled to each of the chambers and respectively arranged, upon being opened, for selectively communicating the chambers with discharge ports or laterally-directed orifices 35 and 36. Switches 37 and 38 are cooperatively arranged within the surface instrumentation 16 to connect the power source 17 by way of selected conductors in the cable 15 to the solenoid valves 33 and 34 as required for individually ejecting discrete minor volumes of the tracers 25 and 26 into the well bore 11 upon command.

The new and improved survey tool 10 also includes tracer-detecting means 39 cooperatively arranged for supplying distinctive output signals to the surface instrumentation 16 whenever there is a movement past the tool of either of the two well bore fluids 12 and 13 which are bearing detectable amounts of the tracers 25 and 26 previously released from the tracer-ejecting means 22. As depicted in FIG. 1, in the preferred embodiment of the tracer-survey tool 10, the tracer-detecting means 39 include an upper pair of typical radiation detectors 40 and 41 mounted at longitudinally-spaced intervals above the upper tracer nozzle 35 as well as a lower single radiation detector 42 which, in accordance with the principles of the present invention, is mounted below the lower tracer nozzle 36. As is conventional the radiation detectors 40–42 are each coupled to suitable amplifiers and other downhole electronic circuitry (not shown) sealingly enclosed in the tool body 14, with these circuit elements all being cooperatively arranged for producing individual output electrical signals from each detector. The detector signals are transmitted to the surface instrumentation 16 by way of electrical conductors in the cable 15 for display on the CRT recorder 18; and, as its associated film is advanced at a constant and known speed, these measurements are successively recorded as individual time-based curves.

Those skilled in the art will appreciate, of course, that the accuracy and reliability of the measurements provided by the new and improved survey tool 10 will be directly related to how completely and quickly the tracers 25 and 26 become intermixed with the well bore fluids 12 and 13 adjacent to the tool. It should also be recognized that by using tracer materials which are intimately associated with or previously dissolved in a carrier liquid that is easily mixed or highly soluble within the particular fluid that is to be measured, the subsequent intermixing of these substances in the well bore fluids will be significantly promoted. Accordingly, when practicing the present invention in a well, as at 11, containing oil and water, it is preferred that one of the tracer materials, such as at 25, be an oil-miscible radiation-emitting liquid and that the other tracer material, as at 26, be a water-miscible radiation-emitting liquid. In this manner, the use of the water miscible tracer 26 will be of particular advantage in following the movements of the water 13 when water is the heavier well bore fluid and is the continuous-phase fluid in that interval of the well bore 11. Similarly, use of the oil-miscible tracer 25 will facilitate subsequent measurements of the movement of oil whether it is the continuous-phase fluid in that interval of the well bore 11 or, as shown at 12, is simply bubbling up through continuous-phase water as at 13. In a similar fashion, where gas is present in a given well, a suitable gas-miscible tracer could alternatively be placed in one or the other of the two chambers 23 and 24.

When the biphasic fluids are in the form where water is the continuous-phase fluid (such as at 13 in FIG. 1) through which discrete bubbles of oil (such as at 12 in FIG. 1) are passing, from a practical standpoint it has been difficult, if not impossible, heretofore to reliably achieve intermixing of the tracer fluid, as at 25, with the oil bubbles even though the tracer carrier is otherwise fully compatible with the connate oil forming those bubbles. Instead, based upon observations during laboratory tests simulating dynamic flow conditions in a vertical pipe, it appears that with conventional techniques and prior-art tracer tools, after the ejected tracer material (such as the oil-miscible liquid 25) enters the well bore 11 it merely rises as a separate stream of small droplets passing through the continuous-phase connate water 13 and, ordinarily, will never enter nor become intimately intermixed with the oil bubbles 12. This, of course, results in a separate stream of tracer droplets moving, at least for the large part, wholly independently of and at a different velocity then either the oil bubbles 12 or the continuous-phase water column 13.

Although this particular feature is not itself within the scope of the new and improved methods and apparatus of the present invention, the tracer-survey tool 10 preferably includes an oil-diverting device 43 which, in its most useful form, includes an elongated, depending deflector 44 having its upper end pivotally mounted, as at 45, on the tool body 14 immediately above the discharge nozzle 35 for the oil-miscible tracer 25. To control the deflector 44, its lower end is pivotally coupled, as at 46, to an upwardly-inclined strut or support arm 47 having its lower end movably coupled to the body 14 by a slide member 48 slidably mounted in an elongated longitudinal groove on the tool body. A tension spring 49 is arranged for urging the slide block 48 upwardly so as to bias the deflector to an extended position. By shaping the underside of the deflector 44 to define a generally-arcuate or concave cross-section, when the tool 10 is being operated in a well where oil is bubbling upwardly in a continuous-phase column of water, the deflector will, upon its extension, present a substantial obstruction to the upwardly-moving oil bubbles, as at 12, but still be capable of being retracted against the tool body 14 should the deflector encounter a restriction in the well bore 11.

When the new and improved survey tool 10 is stationed at a selected depth location in the well bore 11 it will be appreciated that to obtain measurements from which the flow velocity of the oil bubbles, as at 12, can be determined, the power source 17 is momentarily connected, as by the switch 37, to the cable for energizing the solenoid valve 33 for a controlled time interval. So long as the solenoid valve 33 is open, the relatively-constant force of the spring 29 acting on the piston 27 will, of course, be effective for expelling a known, measured minor amount of the oil-miscible tracer 25 in a concentrated stream from the nozzel 35. As illustrated in FIG. 2, this will allow the concentrated stream of the tracer 25 to directly impinge any bubbles of oil, as at 50, which may then be passing through the narrowed or restricted opening, as at 51, defined between the tool body 14 and the arcuately-shaped upper edge of the deflector 44.

It will be noted that in addition to diverting many of the oil bubbles, as at 50, through the restricted opening 51, the concave underside of the deflector 44 is also effective for gathering many of these diverted bubbles into so-called "slugs" as at 52. It will be appreciated, therefore, that as a coalesced oil slug, as at 52, passes through the restricted opening 51, the expelled stream of the tracer 25 will be even more apt to penetrate the outer envelope of the oil slug.

Similarly, when the velocity of the continuous-phase well bore fluid, such as the water column 13, is to be measured in accordance with the principles of the present invention, the switch 38 is momentarily closed to energize the solenoid valve 34 for ejecting a discrete amount of the water-miscible tracer 26. Hereagain, each time the valve 34 opens, the tracer 26 will be expelled at a constant rate inasmuch as the spring 30 maintains the pressure in the chamber 24 at a constant differential above the pressure in the well bore 11.

As is customary with typical tracer-survey operations, the recorder 18 is adapted to alternatively provide both depth-based and time-based recordings. In one manner of achieving this dual capability, the recorder 18 is selectively connected, as by a switch 53, to a typical pulse generator 54 which, in response to the movements of the depth-measuring wheel 21, functions to record depth-related input signals such as those provided by the collar locator 19 as a function of the respective depth locations of the tool 10 in the well bore 11. By operating the switch 53 to disconnect the depth-pulse generator 54 and instead connect the recorder 18 to a typical computer-controlled clock or a timing-mark pulse generator 55, as the film is advanced at a constant rate through the recorder a series of time-based reference indicia will be produced along a desired track on the recorder film to provide a basis for determining the time relationship between the various input signals from the radiation detectors 40–42 as well as those signals representative of the operations of the solenoid valves 33 and 34.

In waterflood injection wells, it has, of course, been a long-standing practice to station a typical tracer-survey tool at a given depth location in the well, operate the tool to discharge a water-miscible tracer into the well bore, and then monitor one or more radiation detectors at fixed distances downstream of the tracer-ejection point. Then, by simply measuring the time required for the water-borne tracer either to travel from the ejection point past each of the detectors or travel between the two detectors the water velocity at that depth location can, of course, be easily determined.

This situation is not true, however, in multiphase production wells. Instead, it has been found from laboratory tests simulating downhole conditions in such wells, that as a stream of oil bubbles rise in a static column of water, a small quantity of water will be carried upwardly along with each oil bubble. Observations indicate that water transported in this manner will be in the form of small bubbles of water which are either entrained within the oil bubbles or are carried along in the wake of the oil bubbles.

At the same time, these laboratory tests further indicated that as water is transported upwardly by the upwardly-traveling oil bubbles, a corresponding downward movement of water is developed in the continuous-phase water. Similar observations are noted even where the column of water is also moving upwardly. In either situation, these erratic water movements apparently vary directly in accordance with the flow rates of the oil bubbles in the water column. In a like manner, where oil is the heavier, continuous-phase fluid and gas is the lighter, discontinuous-phase fluid, there will be corresponding countercurrent flows which are also induced in the oil by the rising gas bubbles. As a result, it will be recognized that routine time-based tracer-survey measurements such as commonly employed in tracing the flow of monophasic liquids are not at all suited for accurately determining the dynamic flow characteristics of continuous-phase heavier fluid in typical production wells containing a discontinuous-phase lighter fluid such as oil.

However, in accordance with the principles of the present invention, it has been found that by employing a pair of radiation detectors, as at 41 and 42, which are spatially disposed above and below the discharge nozzle 36 for the water-miscible tracer 26, the measurements respectively provided by those detectors can be uniquely correlated for accurately determining the velocity and direction of the heavier, continuous-phase fluid, such as the water column 13, in a production well as at 11. As will be subsequently explained, in the preferred embodiment of the new and improved survey tool 10, the ejector nozzle 36 is located midway between the detectors 41 and 42.

It will be recognized, of course, that a wide variety of conditions can be encountered in a given production well as at 11. For instance, it is not at all uncommon to find a well with a static column of water through which bubbles of oil are rising. As discussed above in reference to FIG. 2, the velocity of the oil rising through that static water column is determined by ejecting one or more discrete quantities of the oil-miscible tracer 25 into the well bore fluids and measuring the elapsed time before a tracer-bearing oil bubble or slug passes either or both of the two higher detectors 40 and 41. These differential time measurements are, of course, readily obtained by operating the recorder 18 to provide a time-based log with curves representative of the respective output signals from the detectors 40 and 41 as well as a suitable event mark each time the solenoid valve 33 is opened.

Figure 3:
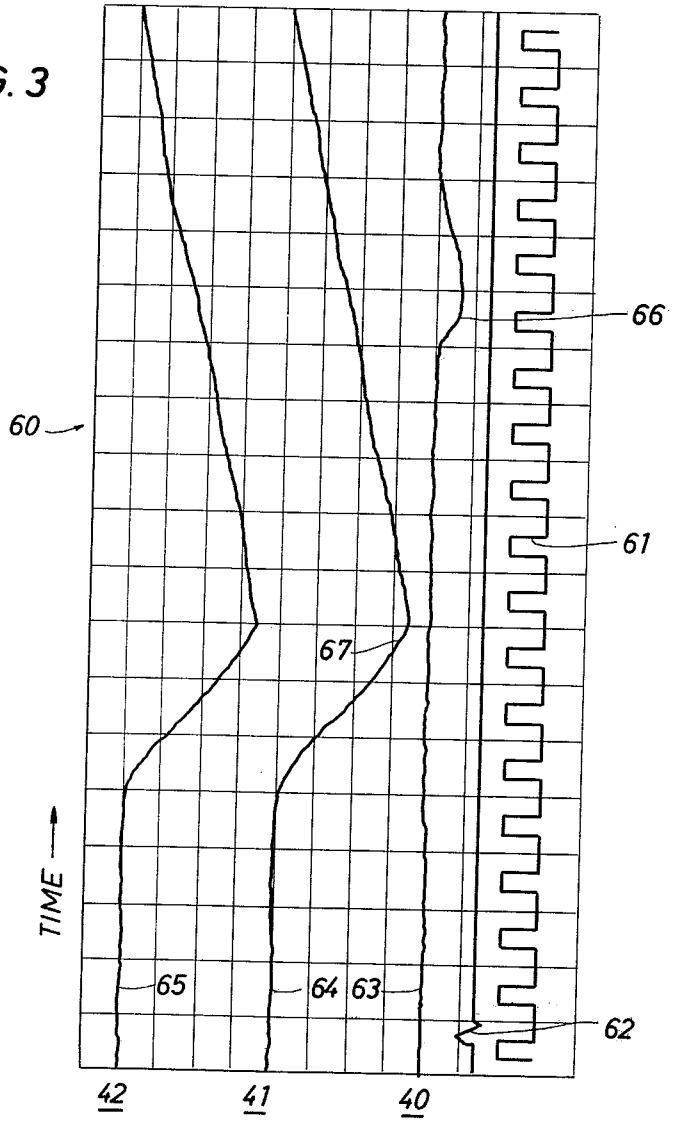

Similarly, as schematically represented in FIG. 3, when the new and improved survey tool 10 is stationed in a static column of well bore water and the solenoid valve 34 is momentarily opened to discharge a minor amount of the water-miscible tracer 26, a log is obtained as shown generally at 60. As depicted by the log 60, the recorder 18 and the timing-mark generator 55 are cooperatively arranged for producing a series of uniform time marks, as at 61, along a selected track on the film to facilitate the accurate determination of the time differentials between any of the several events that will be recorded on the log. It is also preferred that the surface instrumentation 16 be further arranged to provide some suitable event indicia or distinctive mark, as at 62, at another track on the log 60 whenever the solenoid valve 34 is operated.

Accordingly, as depicted by the log 60, until such time that the solenoid valve 34 is operated, the output signals from the radiation detectors 40–42 (as respectively represented by the several traces 63–65) will each show a zero-based background level of radioactivity in the well bore. Those skilled in the art will understand, of course, that the recorder 18 can obviously be adjusted to horizontally position each of the traces 63–65 to extend along any selected track on the log 60.

As discussed above, the aforementioned laboratory observations indicate that the movement of even a limited flow of oil bubbles in a static column of water will result in an upward transportation of minor, but significant, amounts of water along with the oil bubbles as well as develop a corresponding downward displacement or travel of equal amounts of water even though the column of well bore water is otherwise considered to be static. Thus, as demonstrated by the uniformly-paralleled traces 64 and 65 respectively representing the recorded output signals of the detectors 41 and 42 immediately above and below the tracer nozzle 36, upon ejection of a discrete quantity of the water-miscible tracer 26 there will be a uniform upward and downward dispersion of the tracer in the well bore. Thus, since there is no net gain or loss of water in the well bore, the center of activity for the dispersed tracer will tend to remain at about the same depth location as the nozzle 36 until the small amount of the tracer 26 becomes so widely dispersed that the level of radioactivity in the well bore adjacent to each of the detectors 40–42 will again be negligible.

It will be appreciated, therefore, that in keeping with the principles of the present invention, the symmetry of all portions of the traces 64 and 65 has been found to be a recognizable characteristic from which it can be reasonably concluded that the new and improved tracer tool 10 is then operating in a static column of the heavier well bore fluid which, in the depicted instance, is water. It should be recognized that the minor and momentary increase in the level of radioactivity adjacent to the uppermost detector 40 (as indicated at 66 on the log trace 63) is representative only of the later passage of the upper portion of the tracer charge which (as indicated at 67 on the log trace 64) had previously passed the intermediate detector 41. Hereagain, it should be understood that a log similar to the log 60 will be obtained should the heavier, continuous-phase fluid be oil and the lighter, discontinuous-phase fluid be gas. In that situation, the resulting log will be similar except for a possibly-quicker dispersion of the tracer and correspondingly-quicker responses by the detectors 41 and 42.

As a further aid to understanding the scope of the present invention, it should be noted that the difference in the intensity of radioactivity as respectively indicated by the two curve portions 66 and 67 is directly related to the difference in the longitudinal or vertical spacings between the nozzle 36 and the detectors 40 and 41. In other words, since only a limited and fixed mass or quantity of a radioactive tracer, as at 26, is ejected at any given time, as the tracer charge spreads away from the nozzle 36 the level of intensity of radioactivity at the upper and lower boundaries of the charge mass will correspondingly decrease as those boundaries respectively move further apart. This is, of course, true whether a given charge is large or small and even though a different quantity of tracer may be ejected each time the tool 10 is operated.

Figure 4:
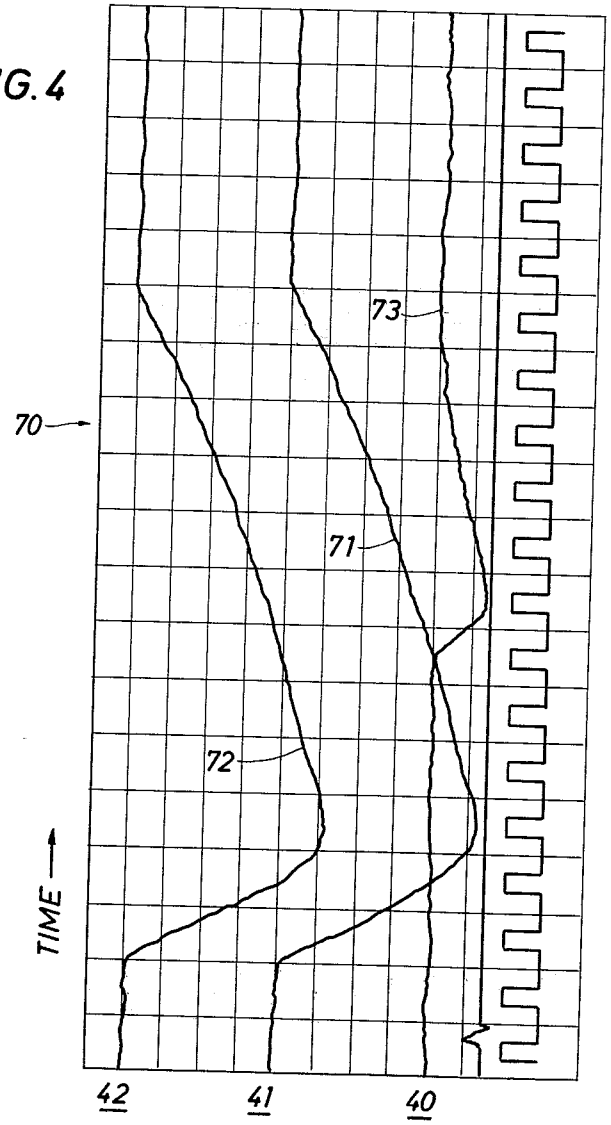
FIGS. 3–8 show representative logging records as will be typically obtained when the methods of the present invention are being practiced within different production wells, with these records being adapted to respectively illustrate significant distinctions in the measurements that may be commonly expected under various flow conditions.

Turning now to FIG. 4, a representative log 70 is depicted there to illustrate the practice of the present invention when the new and improved tool 10 is again operated in a static column of water but, in distinction to the situation just described by reference to FIG. 3, where there is now a significant flow of oil bubbles rising through the water column. Hereagain, as is the case where there is only limited flow of oil, the detectors 41 and 42 will be simultaneously exposed to the same level of radioactivity in the adjacent well bore fluids as the upper and lower boundaries of the dispersing mass of the tracer 26 pass the detectors. Thus, in a similar fashion to the log 60, the log 70 will also have the two paralleled traces 71 and 72 respectively representative of the responses of the detectors 41 and 42 and the individual log trace 73 representing the response of the uppermost detector 40. Again, the delayed and somewhat-diminshed response of the uppermost detector 40 (as depicted by the trace 73) is indicative only of the subsequent passage of the upper boundary of the tracer mass; and the distinguishing characteristic of paralleled responses from the detectors 41 and 42 (as shown by the log traces 71 and 72) again clearly represents that the tool 10 is in a static water column.

Figure 6:
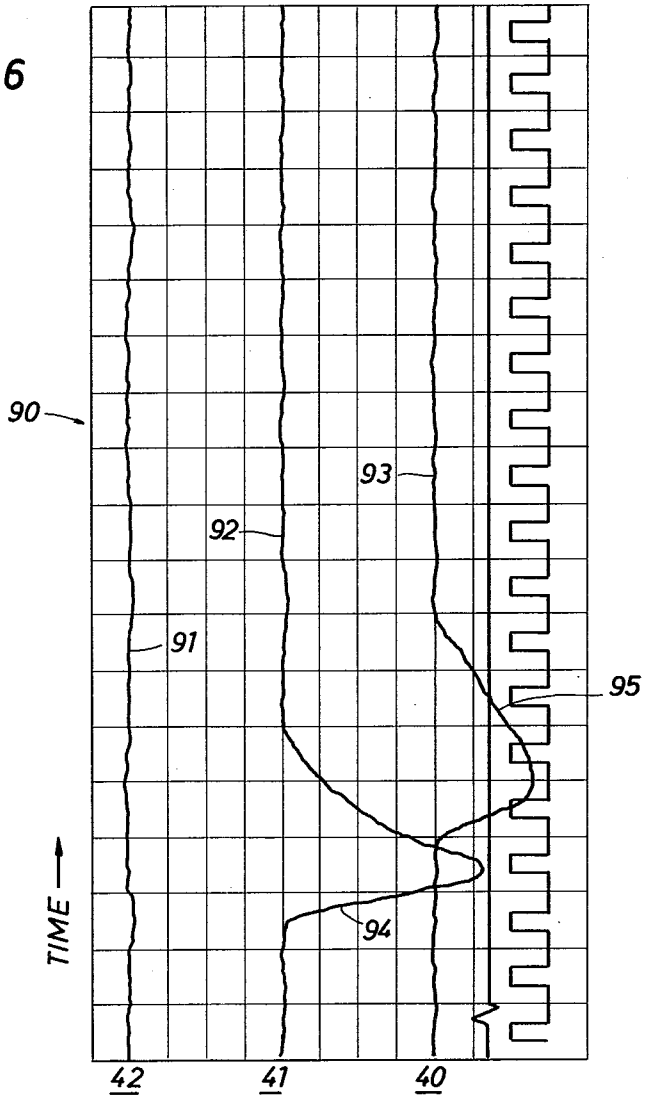
Figure 5:
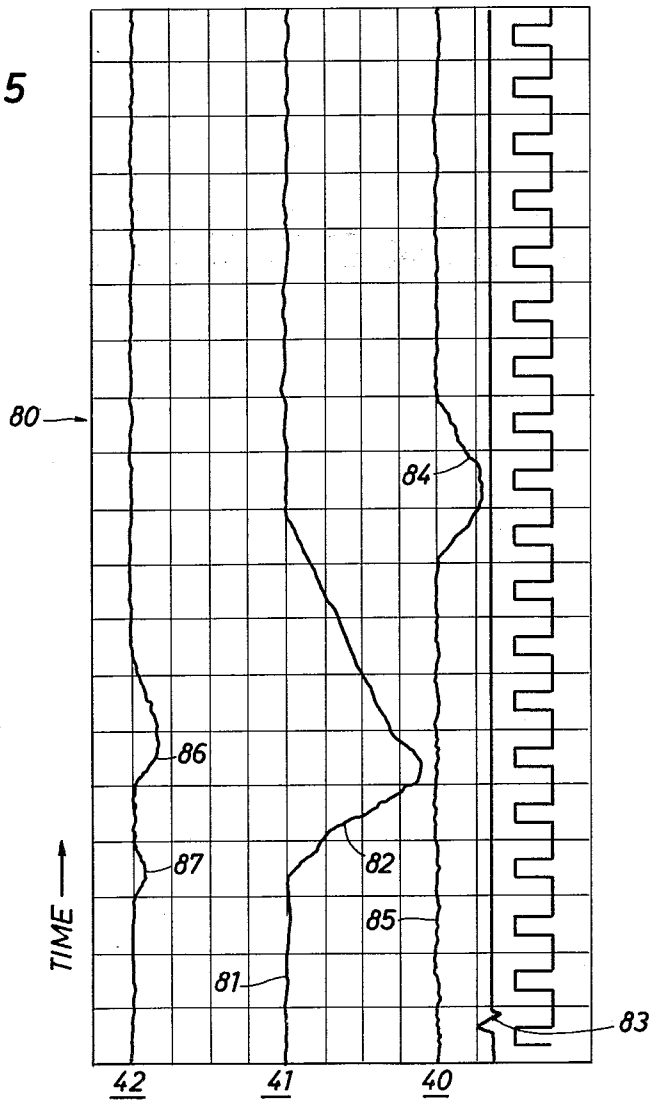

Turning now to FIGS. 5 and 6, the two logs 80 and 90 depicted there respectively illustrate the responses of the new and improved tracer-survey tool 10 where, on the one hand, the tool is operated in a slowly-rising water column and, on the other hand, the tool is operated in a faster-moving column of water. To more accurately illustrate the effects of the increased water velocity, in both cases it is assumed that there is an equal, but minor, flow of oil bubbles rising through each of the two upwardly-moving water columns.

A comparison of the logs 80 and 90 readily indicates that the responses of the detectors 40 and 41 are not paralleled as was noted on the logs 60 and 70. Instead, as shown for example by the log trace 81, there is a distinct increase in the response of the intermediate detector 41 (as shown by the curve portion 82) occurring following a first determinable time interval after ejection of the tracer (as indicated by the event mark 83); and, following a second determinable time interval, there is a distinct increased response of the upper detector 40 (as shown by the curve portion 84 on the log trace 85). In contrast to the symmetry of the log traces showing the response of the detectors 41 and 42 when the tool 10 is in a static water column, there is only a limited response of the lower detector 42 as indicated by the minor deviation, as at 86, on the log trace 87. The minor deviation 86 is considered as showing that although there is still a downward displacement movement of water created by the rising oil bubbles, the overall upward movement of water has carried the center of the dispersed mass of tracer upwardly at a sufficient velocity that, at best, only a very limited amount of tracer will ever pass the lower detector 42. It will be noted that, on the other hand, the log trace 91 on the log 90 shows no detectable response from the lower detector 42 since the higher flow rate of water (as previously assumed) will have carried the dispersed tracer mass upwardly before the lower boundary of that mass will have had time to have moved downwardly past the lower detector.

As illustrated on the log 90, at higher water velocities, the tracer-responsive indicia on the log traces 92 and 93 will occur more quickly than will be the case at lower water velocities. Thus, as shown at 94, when the tracer 26 is ejected, there will be only a short first time interval before there is a response from the intermediate detector 41; and as shown by the curve portion 95, a short second time interval will elapse before there is a corresponding response from the upper detector 40. Hereagain, it will be noted that in comparison to the corresponding response of the intermediate detector 41, the progressively-increasing dispersion of the upwardly-moving mass of the tracer will cause a commensurate decrease in the response of the upper detector 40.

Figure 7:
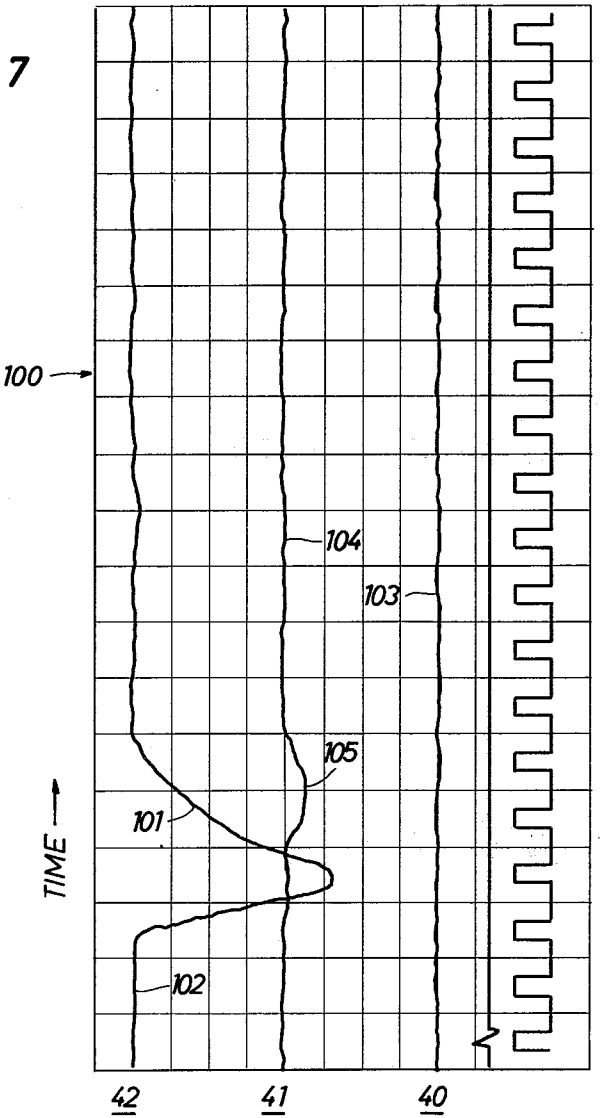

Those skilled in the art will, of course, appreciate that it is not at all uncommon to find water moving downwardly in a production well such as where water is produced from a higher formation interval and enters a lower formation interval which is at a lower pressure. Accordingly, as represented by the typical log 100 shown in FIG. 7, where there is a downward flow of water in a production well over and above any minor upward movements of water created by rising oil bubbles in the surrounding water column there will be a characteristic increased response (as shown at 101 on the log curve 102) from only the lowermost detector 102 and, in many cases, no response from the two upper detectors 40 and 41 as respectively shown by the log traces 103 and 104. There is, however, a possibility that a limited response, as at 105, may occasionally occur on the log trace 104 should there be sufficient oil flow to transport a minor amount of the water-miscible tracer 26 past the intermediate detector 41. In any event, the major response, as at 101, is the distinguishing characteristic provided by the new and improved tool 10 when there is downward flow of water in a production well.

It will be recognized that the foregoing discussion has been directed to those situations where water is the heavier, continuous-phase fluid. However, as is not at all uncommon, in production wells with multiple oil-producing formations the dynamic conditions in the well can change so that at a higher depth location the continuous phase is oil and water is instead bubbling through the oil. In those situations, when the oil velocity at those higher depth locations is to be measured, the new and improved tracer-survey tool 10 is operated to simply discharge a quantity of the oil-miscible tracer 25 and elapsed time measurements are ordinarily obtained by monitoring the upper and intermediate detectors 40 and 41. The deflector 44 will, however, be of no advantage where the oil is the continuous-phase fluid since water bubbles seem to be unaffected by the deflector. Thus, ejection of the water-miscible tracer 26 will not allow reliable measurements to be obtained of the dynamic characteristics of the water bubbles in a continuous-phase oil environment or regime.

Figure 8:
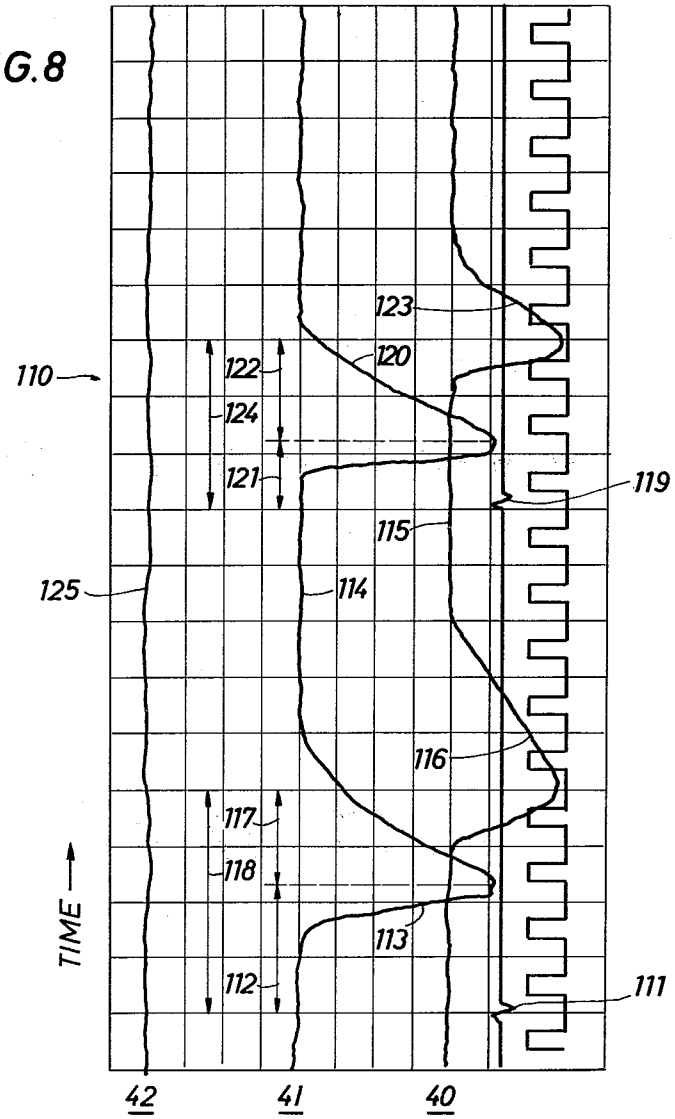

It will, therefore, be appreciated that the new and improved survey tool 10 is uniquely arranged to provide measurements from which many individual dynamic flow characteristics of both the oil and water phases in a typical production well can be readily determined with a fair degree of accuracy. As an example of this unique capability, the log 110 depicted in FIG. 8 is presented to show representative responses as may occur when the tool 10 is operated in a production well where there is a major upward flow of water (exactly as depicted in FIG. 6) associated with a moderate flow of oil bubbles.

Accordingly, in operating the survey tool 10, once it is positioned at a selected depth location in a production well, such as the well 11, the switch 38 may, if desired, be operated first so as to momentarily open the solenoid valve 34 and expel a discrete volume of the water-miscible tracer 26 into the adjacent column of connate water 13. As indicated at 111, operation of the valve 34 is appropriately recorded on the log 110. Thereafter, as previously discussed with respect to the representative situation depicted in FIG. 6, there will be a brief first time interval 112 between the operation of the solenoid valve 34 and a distinguishable response by the intermediate detector 41 such as shown by an identifiable peak on a curve portion 113 of the log trace 114 representing the response of that detector. It will, of course, be appreciated that once the time interval 112 is measured, the velocity of the upwardly-moving water in that interval of the well can be readily determined.

In a similar fashion, it should also be recognized that there is also a distinguishable response by the upper detector 40. Thus, as the ejected tracer material 26 travels upwardly, the log trace 115 produced by the upper detector 40 will similarly show a temporary increased response, as at 116, at a determinable time interval 117 after the corresponding increased response 113 of the intermediate detector 41. Since it is quite unlikely that there could be an undetected loss or gain of water in that interval of the well bore 11 which is then between the upper detector and the ejector nozzle 36, it is, of course, quite convenient to consider the several recorded time intervals 112, 117 and 118 and the corresponding differences in spacing between the ejector nozzle and the two detectors 40 and 41 to arrive at an average velocity of the continuous-phase water in that particular well bore interval.

As previously described, when it is desired to also determine the velocity of the bubbling oil in that interval of the well bore 11 that the new and improved survey tool 10 is then stationed, it is necessary only to momentarily close the solenoid switch 37 (such as indicated by the event mark 119 on the log 110) for discharging a discrete quantity of the oil-miscible tracer 25 into the well bore 11. Then, assuming that the deflector 44 has gathered at least some of the upwardly-flowing oil and the ejected tracer 25 was successful in penetrating one or more passing bubbles or oil slugs, as at 50 and 52, the detectors 40 and 41 will again function to provide increased responses at different time intervals following the discharge of that tracer.

For instance, as shown by the increased response curve portion 120 on the log trace 114, at a first determinable time interval 121 following ejection of the oil-miscible tracer 25, the intermediate detector will give a response indication passage of that tracer. Then, after a second determinable time interval 122, there will be an increased response, as at 123, on the log trace 115 which similarly indicates that the ejected tracer 25 has now passed the upper detector 40. Hereagain, the two time intervals 121 and 122 as well as the summation 124 of those two time intervals will allow a fairly accurate determination to be made of the velocity of the oil bubbles 12 in that interval of the well bore 11.

As previously discussed, the oil bubbles 12 will always rise at a higher speed than any surrounding column of water, as at 13. Thus, should a discharged quantity of the oil-miscible tracer 25 fail to penetrate an oil bubble 50 or slut 52, that mass of the tracer will simply be carried upwardly in the well bore 11 by the rising water column 13. This will, however, be readily detected since the resulting curve portions 120 and 123 instead will respectively be identical to the curve portions 113 and 116 and the several time intervals 112, 117, 118 will also respectively correspond to the time intervals 121, 122 and 124. This is, of course, not at all the case with the typical log 110 in FIG. 8.

It should be noted in passing that the unvarying log trace 125 indicates merely that no tracer was carried by the lower detector 42. As another point of consideration, it will, of course, be recognized by those skilled in the art that the new and improved survey tool 10 can either be operated alone or in combination with other types of production-logging tools.

Accordingly, it will be appreciated that the present invention has provided new and improved methods and apparatus for determining one or more dynamic flow characteristics of the heavier, continuous-phase fluid in biphasic well bore fluids. To obtain measurements representative of such characteristics, tracer-ejecting means are cooperatively arranged for selectively ejecting discrete amounts of one or the other of two radioactive tracers into the fluids at a selected depth location in a production well. When, for instance, the tracer-survey tool of the present invention is stationed at a depth location where the heavier, continuous-phase fluid is water, upon ejection of a water-miscible tracer, monitoring of radiation detectors above and below the ejection point will facilitate a ready determination of whether the water is moving or is static and, if it is moving, the direction and velocity of the water column. A similar response is permitted where gas is bubbling through a continuous-phase column of oil. Conversely, when the new and improved tool is being operated in a continuous-phase oil column with water passing therethrough, monitoring of one or more detectors spaced above the ejection point of the oil-miscible tracer will also provide measurements from which the velocity of the continuous-phase oil column can be determined.

While only a particular embodiment of the present invention and mode of practicing the invention have been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. A method for determining at least one dynamic flow characteristic of biphasic well bore fluids within a selected interval of a production well where there are bubbles of a lighter, discontinuous-phase fluid passing through a column of a heavier, continuous-phase fluid, and comprising the steps of:

discharging a fluid-miscible radioactive tracer into the well bore fluids at a chosen depth location within said selected well interval for mixing at least a portion of said tracer with the continuous-phase fluid therein;

following the discharge of said tracer, obtaining at least one indication functionally related to the level of radioactivity in the continuous-phase fluid then above said chosen depth location and at least another indication functionally related to the level of radioactivity in the continuous-phase fluid then below said chosen depth location; and correlating said indications with one another for determining at least one dynamic flow characteristic of the continuous-phase fluid within said selected well interval.

2. The method of claim 1 wherein the lighter, discontinuous-phase fluid is oil, the heavier, continuous-phase fluid is water, and said tracer is a water-miscible fluid.

3. The method of claim 1 wherein the lighter, discontinuous-phase fluid is gas, the heavier, continuous-phase fluid is oil, and said tracer is an oil-miscible fluid.

4. The method of claim 1 wherein correlation of said indications shows there is a substantial correspondence therebetween thereby representing that there is no significant net movement of the continuous-phase fluid within said selected well interval.

5. The method of claim 4 wherein the lighter, discontinuous-phase fluid is oil, the heavier, continuous-phase fluid is water, and said tracer is a water-miscible fluid.

6. The method of claim 4 wherein the lighter, discontinuous-phase fluid is gas, the heavier, continuous-phase fluid is oil, and said tracer is an oil-miscible fluid.

7. The method of claim 1 wherein correlation of said indications shows that the level of radioactivity in the continuous-phase fluid then above said chosen depth location exceeds the level of radioactivity in the continuous-phase fluid then below said chosen depth location thereby representing that there is a net upward movement of the continuous-phase fluid through said selected well interval.

8. The method of claim 7 wherein the lighter, discontinuous-phase fluid is oil, the heavier, continuous-phase fluid is water, and said tracer is a water-miscible fluid.

9. The method of claim 7 wherein the lighter, discontinuous-phase fluid is gas, the heavier, continuous-phase fluid is oil, and said tracer is an oil-miscible fluid.

10. The method of claim 1 wherein the lighter, discontinuous-phase fluid is oil, the heavier, continuous-phase fluid is water, and said tracer is a water-miscible tracer; and correlation of said indications shows that the level of radioactivity in the continuous-phase water then below said chosen depth location exceeds the level of radioactivity in the continuous-phase water then above said chosen depth location thereby representing that there is a net downward movement of the continuous-phase water through said selected well interval.

11. The method of claim 1 wherein said indications are obtained substantially simultaneously.

12. The method of claim 1 wherein said one indication and said other indication are respectively obtained at upper and lower monitoring points which are equally spaced above and below the discharge point of said tracer.

13. The method of claim 12 wherein said indications are obtained substantially simultaneously.

14. The method of claim 13 wherein correlation of said indications show substantially-equal levels of radioactivity in the continuous-phase fluids respectively then adjacent to said upper and lower monitoring points thereby representing that there is no significant net movement of the continuous-phase fluid within said selected well interval.

15. The method of claim 13 wherein correlation of said indications shows that the level of radioactivity in the continuous-phase fluid then adjacent to said upper monitoring point is greater than the level of radioactivity in the continuous-phase fluid then adjacent to said lower monitoring point thereby representing that there is a net upward movement of the continuous-phase fluid through said selected well interval.

16. The method of claim 15 further including the steps of:

measuring the time interval between the movement of the tracer-bearing continuous-phase fluid between a selected reference point and said upper monitoring point as indicated by the occurrence of said one indication for determining the travel time of the continuous-phase fluid between said selected reference point and said upper monitoring point; and dividing the distance between said selected reference point and said upper monitoring point by said travel time for determining the velocity of the continuous-phase fluid upwardly through said selected well interval.

17. The method of claim 16 wherein said selected reference point is below said upper monitoring point.

18. The method of claim 17 wherein said selected reference point is said discharge point of said tracer, and said time interval is the elapsed time between the discharge of said tracer and the subsequent passage of the tracer-bearing continuous-phase fluid past said upper monitoring point.

19. The method of claim 13 wherein the lighter, discontinuous-phase fluid is oil, the heavier, continuous-phase fluid is water, and said tracer is a water-miscible fluid; and correlation of said indications shows that the level of radioactivity in the continuous-phase water then adjacent to said lower monitoring point is greater than the level of radioactivity in the continuous-phase water then adjacent to said upper monitoring point thereby representing that there is a net downward movement of the continuous-phase water through said selected well interval.

20. The method of claim 19 further including the steps of:

measuring the time interval between the movement of the tracer-bearing continuous-phase water between a selected reference point and said lower monitoring point as indicated by the occurrence of said other indication for determining the travel time of the continuous-phase water between said selected reference point and said lower monitoring point; and dividing the distance between said selected reference point and said lower monitoring point by said travel time for determining the velocity of the continuous-phase water downwardly through said selected well interval.

21. The method of claim 20 wherein said selected reference point is above said lower monitoring point.

22. The method of claim 21 wherein said selected reference point is said discharge point of said water-miscible tracer, and said time interval is the elapsed time between the discharge of said water-miscible tracer and the subsequent passage of the tracer-bearing continuous-phase water past said lower monitoring point.

23. A method for determining dynamic characteristics representative of the flow of a heavier continuous-phase fluid within a selected interval of a production well through which a lighter discontinuous-phase fluid is bubbling and comprising the steps of:

discharging at an intermediate location in said selected well interval a detectable quantity of a radioactive tracer which is miscible with the heavier continuous-phase fluid for irradiating at least some of the heavier continuous-phase fluid then within said selected well interval;

monitoring the level of radioactivity at spaced first and second locations in an upper portion of said selected well interval above said intermediate location for providing first and second measurement signals respectively indicative of the subsequent passage of an upwardly-moving increment of said irradiated continuous-phase fluid through said upper portion of said selected well interval;

monitoring the level of radioactivity at a third location in a lower portion of said selected well interval below said intermediate location for providing at least a third measurement signal indicative of the subsequent passage of a downwardly-moving increment of said irradiated continuous-phase fluid through said lower portion of said selected well interval; and correlating said first, second and third measurement signals for obtaining indications representative of the presence of biphasic fluids within said selected well interval as well as determining the direction of movement and flow velocity of the heavier continuous-phase fluid therein.

24. The method of claim 23 wherein said first and third locations are each equally spaced above and below said intermediate location and said second location is above said first location.

25. The method of claim 23 wherein the lighter discontinuous-phase fluid is oil, the heavier continuous-phase fluid is water, and said tracer is water-miscible.

26. The method of claim 23 wherein the lighter discontinuous-phase fluid is gas, the heavier continuous-phase fluid is oil, and said tracer is oil-miscible.

27. The method of claim 23 wherein correlation of said first, second and third measurement signals shows that, following the discharge of said tracer, there is a substantial correspondence between said first and said third measurement signals thereby representing that there is no significant net movement of the continuous-phase fluid within said selected well interval.

28. The method of claim 27 wherein the lighter discontinuous-phase fluid is oil, the heavier continuous-phase fluid is water, and said tracer is water-miscible.

29. The method of claim 27 wherein the lighter discontinuous-phase fluid is gas, the heavier continuous-phase fluid is oil, and said tracer is oil-miscible.

30. The method of claim 23 wherein correlation of said first and second measurement signals with said third measurement signal shows that, following the discharge of said tracer, there is an increase in the level of radioactivity in said upper portion of said selected well interval in relation to the contemporaneous level of radioactivity in said lower portion of said selected well interval thereby representing that there is a net upward movement of the continuous-phase fluid through said selected well interval.

31. The method of claim 30 wherein the lighter discontinuous-phase fluid is oil, the heavier continuous-phase fluid is water, and said tracer is water-miscible.

32. The method of claim 30 wherein the lighter discontinuous-phase fluid is gas, the heavier continuous-phase fluid is oil, and said tracer is oil-miscible.

33. The method of claim 30 wherein said flow velocity is determined by the steps of:

measuring the travel time for a detectable increment of the tracer-bearing continuous-phase fluid to pass upwardly between said spaced first and second locations; and dividing the distance between said spaced first and second locations by said travel time for determining said flow velocity of the continuous-phase fluid then passing upwardly through said selected well interval.

34. The method of claim 30 wherein said flow velocity is determined by the steps of:

measuring the travel time for a detectable increment of the tracer-bearing continuous-phase fluid to pass between said intermediate location and at least one of said spaced first and second locations; and dividing the distance between said intermediate location and said one location by said travel time for determining said flow velocity of the continuous-phase fluid then passing upwardly through said selected well interval.

35. The method of claim 23 wherein the lighter discontinuous-phase fluid is oil and the heavier continuous-phase fluid is water; and correlation of said first and second measurement signals with said third measurement signal shows that, following the discharge of said tracer, there is an increase in the level of radioactivity in said lower portion of said selected well interval in relation to the corresponding level of radioactivity in said upper portion of said selected well interval thereby representing that there is a net downward movement of continuous-phase water through said selected well interval.

36. The method of claim 35 wherein said flow velocity is determined by the steps of:

measuring the travel time for a detectable increment of the tracer-bearing water to pass between said intermediate location and said third location; and dividing the distance between said intermediate location and said third location by said travel time for determining the velocity of water downwardly through said selected well interval.

37. The method of claim 23 wherein said first and third locations are each equally spaced above and below said intermediate location and said first and third measurement signals obtained substantially simultaneously following the discharge of said tracer respectively indicate substantially-equal levels of radioactivity in the continuous-phase fluid then at said first and third locations thereby representing that there is no significant net movement of the continuous-phase fluid within said selected well interval.

38. The method of claim 23 wherein said first and third locations are each equally spaced above and below said intermediate location and said first and third measurement signals obtained substantially simultaneously following the discharge of said tracer collectively indicate that the level of radioactivity in the continuous-phase fluid then at said first location is greater than the level of radioactivity in the continuous-phase fluid then at said third location thereby representing that there is a net upward movement of the continuous-phase fluid through said selected well interval.

39. The method of claim 38 wherein said flow velocity is determined by the steps of:

measuring the elapsed time between the discharge of said tracer and the obtaining of said first measurement signal for determining the travel time of the tracer-bearing continuous-phase fluid upwardly between the discharge point of said tracer and said first location; and dividing the distance between said intermediate location and said first location by said travel time for determining the upward velocity of the continuous-phase fluid through said selected well interval.

40. The method of claim 23 wherein the lighter discontinuous-phase fluid is oil and the heavier continuous-phase fluid is water; and wherein said first and third locations are each equally spaced above and below said intermediate location and said first and third measurement signals obtained substantially simultaneously following the discharge of said tracer collectively indicate that the level of radioactivity in the continuous-phase water then at said third location is greater than the level of radioactivity in the continuous-phase water then at said first location thereby representing that there is a net downward movement of the continuous-phase water through said selected well interval.

41. The method of claim 40 wherein said flow velocity is determined by the steps of:

measuring the elapsed time between the discharge of said tracer and the obtaining of said third measurement signal for determining the travel time of tracer-bearing water downwardly between said tracer-discharge point and said third location; and dividing the distance between said tracer-discharge point and said third location by said travel time for determining the velocity of the continuous-phase water downwardly through said selected well interval.

42. Apparatus adapted for suspension from an electrical cable for determining the respective dynamic flow characteristics of the water and oil-phase constituents of biphasic production fluids in a production well and comprising:

a body;

water-measurement means including a first enclosed chamber on said body and adapted for containing a fluent water-miscible radioactive tracer material, a first tracer-discharge opening on said body, first selectively-operable valve means cooperatively arranged for communicating said first chamber with said first tracer-discharge opening in response to an electrical signal, and means on said body adapted for imposing an elevated pressure on fluent water-miscible materials contained in said first chamber and of sufficient magnitude to expel such materials from said first tracer-discharge opening upon opening of said first valve means;

oil-measurement means including a second enclosed chamber on said body and adapted for containing a fluent oil-miscible radioactive tracer material, a second tracer-discharge opening cooperatively arranged on said body and spatially disposed from said first tracer-discharge opening, second selectively-operable valve means cooperatively arranged for communicating said second chamber with said second tracer-discharge opening in response to an electrical signal, and means on said body adapted for imposing an elevated pressure on fluent oil-miscible materials contained in said second chamber and of sufficient magnitude to expel such materials from said second tracer-discharge opening upon opening of said second valve means; and tracer-detecting means including first and second radiation detectors cooperatively arranged on said body at spaced intervals above said tracer-discharge openings and a third radiation detector cooperatively arranged on said body below said tracer-discharge openings, said radiation detectors being respectively adapted for providing characteristics first, second and third electrical signals representative of the passage of tracer-bearing fluids therepast.

43. The apparatus of claim 42 wherein said first tracer-discharge opening is midway between said first and third radiation detectors.

* * * * *